US011415093B2

(12) United States Patent
Nabeshima et al.

(10) Patent No.: US 11,415,093 B2
(45) Date of Patent: Aug. 16, 2022

(54) ELECTROMAGNETIC FUEL INJECTION VALVE

(71) Applicant: KEIHIN CORPORATION, Tokyo (JP)

(72) Inventors: Yasuhiko Nabeshima, Tochigi (JP); Kento Yoshida, Tochigi (JP); Shou Kanda, Tochigi (JP)

(73) Assignee: Hitachi Astemo, Ltd., Ibaraki (JP)

( * ) Notice: Subject to any disclaimer, the term of this patent is extended or adjusted under 35 U.S.C. 154(b) by 70 days.

(21) Appl. No.: 17/155,685

(22) Filed: Jan. 22, 2021

(65) Prior Publication Data

US 2021/0246858 A1 Aug. 12, 2021

(30) Foreign Application Priority Data

Feb. 6, 2020 (JP) ..... JP2020-019054

(51) Int. Cl.
*F02M 61/20* (2006.01)
*F02M 51/06* (2006.01)

(52) U.S. Cl.
CPC ..... *F02M 51/0625* (2013.01); *F02M 61/20* (2013.01)

(58) Field of Classification Search
CPC . F02M 51/0625; F02M 51/0685; F02M 61/20
USPC ..... 123/490; 251/129.15, 129.16, 129.17, 251/129.18, 129.19, 129.2
See application file for complete search history.

(56) References Cited

U.S. PATENT DOCUMENTS

| | | | |
|---|---|---|---|
| 5,139,224 | A | 8/1992 | Bright |
| 8,646,704 | B2 | 2/2014 | Yamamoto et al. |
| 10,006,428 | B2 | 6/2018 | Yasuda et al. |

FOREIGN PATENT DOCUMENTS

| | | | |
|---|---|---|---|
| JP | 2000-265919 | A | 9/2000 |
| JP | 2005-036696 | A | 2/2005 |
| JP | 2010-229997 | A | 10/2010 |
| JP | 2017-096131 | A | 6/2017 |
| JP | 2018-159294 | A | 10/2018 |
| WO | 2010/009925 | A1 | 1/2010 |
| WO | 2014/196240 | A1 | 12/2014 |

(Continued)

OTHER PUBLICATIONS

Office Action dated Jan. 13, 2021 issued over the corresponding Japanese Patent Application No. 2020-019054.

*Primary Examiner* — Hai H Huynh
(74) *Attorney, Agent, or Firm* — Carrier Blackman & Associates, P.C.; Joseph P. Carrier; William D. Blackman

(57) ABSTRACT

An electromagnetic fuel injection valve includes: a valve body having a rod connected to a valve part; a movable core fitted onto the rod slidably between valve-open side and valve-closed side stoppers; a fixed core having an attracting face opposing the movable core; a valve spring urging the valve body in a valve-closing direction; and an auxiliary spring exhibiting a spring force making the movable core abut against the valve-closed side stopper when a coil is unenergized. A surface, opposing the movable core, of the valve-closed side stopper includes: an annular first curved face part curved convexly toward the movable core and capable of abutting thereagainst; and first and second taper faces continuous respectively to inner and outer peripheral sides of the first curved face part and gradually separated from the movable core in going radially inward and outward, respectively, from the first curved face part.

4 Claims, 5 Drawing Sheets

(56) References Cited

FOREIGN PATENT DOCUMENTS

| | | | |
|---|---|---|---|
| WO | 2016/062594 | A1 | 4/2016 |
| WO | 2018/083795 | A1 | 5/2018 |

VALVE-CLOSED STATE

VALVE-OPEN STATE

ELECTROMAGNETIC FUEL INJECTION VALVE

CROSS REFERENCE TO RELATED APPLICATIONS

The present application claims priority under 35 U.S.C. § 119 to Japanese Patent Application No. 2020-19054 filed Feb. 6, 2020 the entire contents of which are hereby incorporated by reference.

BACKGROUND OF THE INVENTION

Field of the Invention

The present invention relates to an electromagnetic fuel injection valve, particularly, an electromagnetic fuel injection valve comprising a valve housing that has a valve seat in one end part thereof, a hollow fixed core that is connected to another end of the valve housing, a coil that is disposed around an outer periphery of the fixed core, a valve body that is formed by a valve part and a rod connected to the valve part that operates in cooperation with the valve seat, a movable core that is slidably fitted onto the rod while opposing an attracting face of the fixed core, a valve-open side stopper that is fixed to the rod, and configured to make the valve body open by abutting against the movable core that is attracted to the attracting face when the coil is energized, a valve-closed side stopper that is fixed to the rod on a side closer to the valve seat than the valve-open side stopper, a valve spring that urges the valve body in a valve-closing direction, and an auxiliary spring that exhibits a spring force that urges the movable core to move away from the valve-open side stopper and abut against the valve-closed side stopper when the coil is unenergized.

Description of the Related Art

Such an electromagnetic fuel injection valve is known in Japanese Patent Application Laid-open No. 2017-96131.

In such an electromagnetic fuel injection valve, in a valve-opening process, it is only the movable core that slides on the rod of the valve body and is attracted toward the fixed core side; after being accelerated, the movable core pushes upward the valve-open side stopper fixed to the rod against a set load of the valve spring, thus enabling the valve body to be opened promptly, and valve-opening responsiveness of the valve body can be enhanced. Furthermore, in a valve-closing process, the movable core urged by the auxiliary spring abuts against the valve-closed side stopper, and therefore it is possible to minimize an amount of rearward rebound of the valve body due to a seating impact when the valve body is seated on the valve seat for the first time.

Moreover, particularly in the fuel injection valve of Japanese Patent Application Laid-open No. 2017-96131, an annular recess is formed in a surface, opposing the movable core, of each of the stoppers mentioned above, so as to reduce a radial abutting width, and therefore an abutting area, between each stopper and the movable core, thereby enhancing responsiveness of opening and closing of the valve.

In recent years, further improvement in combustion efficiency of an engine is required, and accordingly, it is necessary to control fuel spray (and therefore, the fuel injection valve) with higher accuracy. Therefore, in order to further improve responsiveness of the fuel injection valve, it is desired, for example, to further reduce the above-mentioned abutting area.

SUMMARY OF THE INVENTION

The present invention has been accomplished in light of such circumstances, and it is an object thereof to provide an electromagnetic fuel injection valve that can enhance valve-opening responsiveness by enabling an abutting area between a valve-closed side stopper and a movable core to be minimized compared with a conventional structure, and thus can control a valve body with high accuracy.

In order to achieve the object, according to a first aspect of the present invention, there is provided an electromagnetic fuel injection valve comprising a valve housing that has a valve seat in one end part thereof, a hollow fixed core that is connected to another end of the valve housing, a coil that is disposed around an outer periphery of the fixed core, a valve body that is formed by a valve part and a rod connected to the valve part that operates in cooperation with the valve seat, a movable core that is slidably fitted onto the rod while opposing an attracting face of the fixed core, a valve-open side stopper that is fixed to the rod, and configured to make the valve body open by abutting against the movable core that is attracted to the attracting face when the coil is energized, a valve-closed side stopper that is fixed to the rod on a side closer to the valve seat than the valve-open side stopper and capable of abutting against the movable core, a valve spring that urges the valve body in a valve-closing direction, and an auxiliary spring that exhibits a spring force that urges the movable core to move away from the valve-open side stopper and abut against the valve-closed side stopper when the coil is unenergized, wherein a surface, opposing the movable core, of the valve-closed side stopper includes an annular first curved face part, a first taper face, and a second taper face, the first curved face part having a cross section curved convexly toward the movable core and being capable of abutting against the movable core, the first taper face being continuous to an inner peripheral side of the first curved face part and gradually separated from the movable core in going radially inward from the first curved face part, the second taper face being continuous to an outer peripheral side of the first curved face part and gradually separated from the movable core in going radially outward from the first curved face part.

In accordance with the first aspect, the surface, opposing the movable core, of the valve-closed side stopper includes the annular first curved face part that has the cross section curved convexly toward the movable core and can abut against the movable core. Therefore, in a valve-closed state, the valve-closed side stopper locally abuts against the movable core by bringing the first curved face part into line contact with the movable core, an abutting area therebetween can be greatly reduced, and thus, it is possible to effectively reduce viscosity resistance of fuel between the movable core and the valve-closed side stopper, which may cause sticking of an abutting part therebetween. Accordingly, since the movable core smoothly moves away from the valve-closed side stopper, valve-opening responsiveness can be improved, and the fuel injection valve can be controlled with higher accuracy. Moreover, since the valve-closed side stopper surely abuts via the curved face part (that is, does not abut via an edge) against the movable core, a collision force at the time of abutting is alleviated.

Furthermore, the surface, opposing the movable core, of the valve-closed side stopper includes the first taper face and the second taper face, the first taper face being continuous to the inner peripheral side of the first curved face part and gradually separated from the movable core in going radially inward from the first curved face part, the second taper face being continuous to the outer peripheral side of the first curved face part and gradually separated from the movable core in going radially outward from the first curved face part. Therefore, in the surface, opposing the movable core, of the valve-closed side stopper, parts adjacent to the first curved face part are formed as the first and second taper faces that gradually recede from the first curved face part, and thus, without being interfered by the adjacent parts, it is possible to easily and highly accurately machine with high accuracy the first curved face part over an entire region thereof sandwiched between the first and second taper faces.

According to a second aspect of the present invention, in addition to the first aspect, the first and second taper faces respectively extend in a tangential direction of the first curved face part so as to be continuous to the first curved face part.

In accordance with the second aspect, since the first and second taper faces each extend in the tangential direction of the first curved face part so as to be continuous to the first curved face part, the first curved face part and each of the first and second taper faces can be connected smoothly with each other without any step, and thus, machining can be smoothly transferred from each taper face to the first curved face part.

According to a third aspect of the present invention, in addition to the first aspect, respective radial widths of the first and second taper faces are larger than a radial width of the first curved face part.

In accordance with the third aspect, since the radial width of each of the first and second taper faces is larger than the radial width of the first curved face part, due to each taper face having a wide width, it is possible to reduce the radial width of the first curved face part while securing an axial protrusion height thereof, and accordingly, the first curved face part which requires highly accurate machining is reduced in width (and consequently, reduced in machining amount), thereby making it possible to contribute to improvement in machining efficiency and cost reduction.

According to a fourth aspect of the present invention, in addition to the first aspect, one of mutually opposing surfaces of the fixed core and the movable core includes an annular second curved face part, a third taper face, and a fourth taper face, the second curved face part having a cross section curved convexly toward another one of the mutually opposing surfaces and being capable of abutting thereagainst, the third taper face being continuous to an inner peripheral side of the second curved face part and gradually separated from the other opposing surface in going radially inward from the second curved face part, the fourth taper face being continuous to an outer peripheral side of the second curved face part and gradually separated from the other opposing surface in going radially outward from the second curved face part.

In accordance with the fourth aspect, one of the mutually opposing surfaces of the fixed core and the movable core includes: the annular second curved face part having the cross section curved convexly toward the other of the mutually opposing surfaces and being capable of abutting thereagainst; the third taper face being continuous to the inner peripheral side of the second curved face part and gradually separated from the other opposing surface in going radially inward from the second curved face part; and the fourth taper face being continuous to the outer peripheral side of the second curved face part and gradually separated from the other opposing surface in going radially outward from the second curved face part. Therefore, also on an upstream side of the movable core, since the second curved face part provided in one of the mutually opposing surfaces of the movable core and the fixed core is made to abut locally against the other opposing surface so as to be able to greatly reduce the abutting area, so that it is possible to effectively reduce residual magnetism and the viscosity resistance of fuel between the cores, which may cause sticking of the abutting part therebetween. Accordingly, since the movable core smoothly moves away from the fixed core, the valve-closing responsiveness can be improved, and the fuel injection valve can be controlled with higher accuracy. In addition, since these cores surely abut via the curved face part (that is, do not abut via an edge) against each other, a collision force at the time of abutting is alleviated.

The above and other objects, characteristics and advantages of the present invention will be clear from detailed descriptions of the preferred embodiment which will be provided below while referring to the attached drawings.

DESCRIPTION OF THE PREFERRED EMBODIMENT

Figure 1:
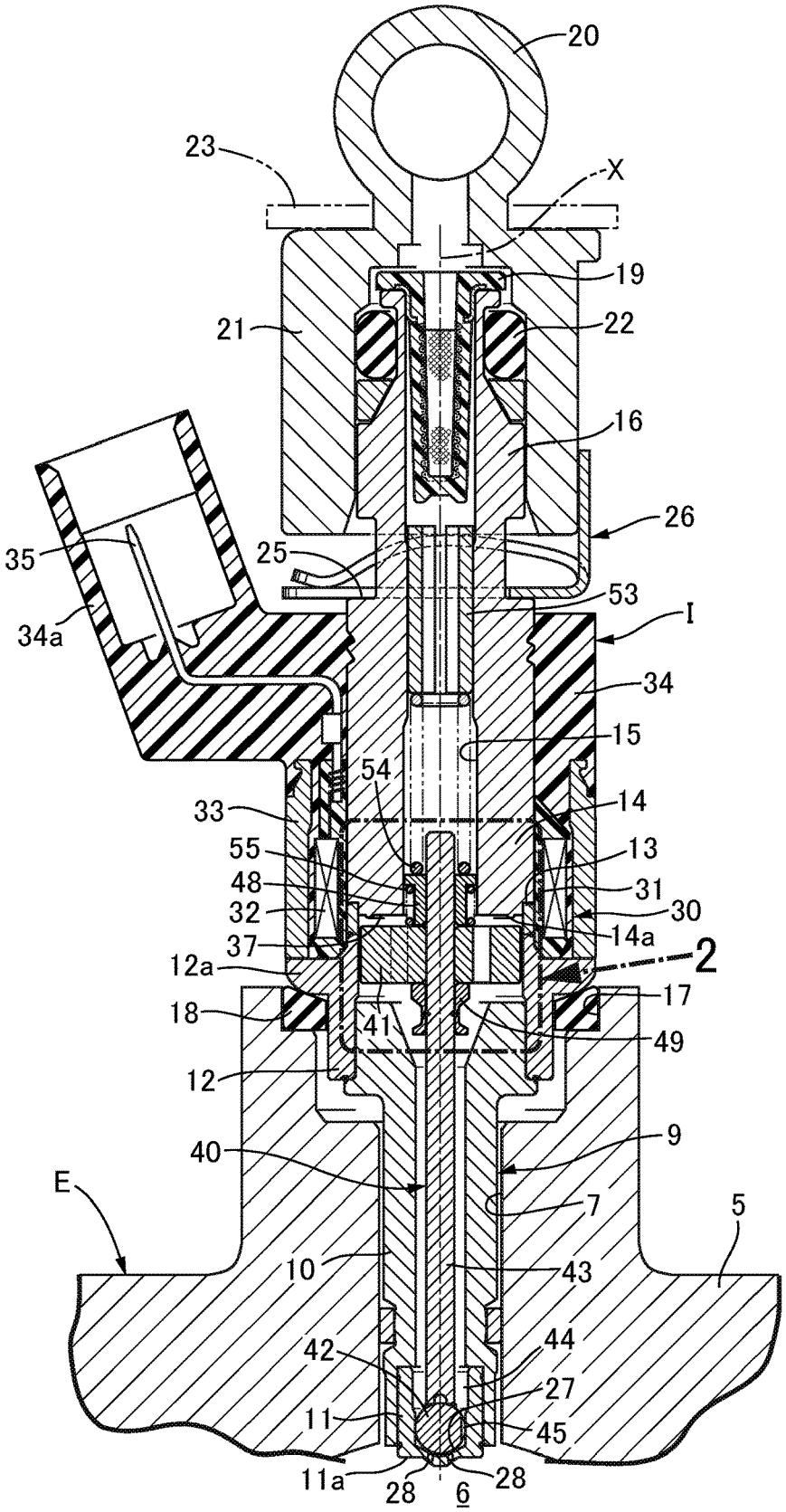
FIG. 1 is a longitudinal sectional view showing one embodiment of an electromagnetic fuel injection valve for an internal combustion engine according to the present invention.

One embodiment of the present invention is first explained by reference to the attached FIG. 1 to FIG. 3. In FIG. 1, an engine body of an internal combustion engine E, for example, a cylinder head 5 is provided with a valve fitting hole 7 opening in a combustion chamber 6, and an electromagnetic fuel injection valve I that can inject fuel toward the combustion chamber 6 is fitted into the valve fitting hole 7. In the electromagnetic fuel injection valve I of the present specification, a fuel injection side is defined as a front side, and a fuel inlet side is defined as a rear side. Moreover, in the present specification, "radial direction" is defined as a radial direction with a central axis X of the fuel injection valve I as a reference, and coincides with a radial direction of each of a fixed core 14, a movable core 41, a rod 43, and a valve-closed side stopper 49 that are coaxially disposed on the central axis X.

A valve housing 9 of the electromagnetic fuel injection valve I is formed from a hollow cylindrical housing body 10, a valve seat member 11 fitted into and welded to the inner periphery of one end part of the housing body 10, a magnetic cylindrical body 12 having one end part thereof fitted onto the outer periphery of the other end part of the housing body 10 and welded to the housing body 10, and a non-magnetic cylindrical body 13 having one end part thereof coaxially joined to the other end part of the magnetic cylindrical body 12.

One end part of a fixed core 14 is coaxially joined to the other end part of the non-magnetic cylindrical body 13, a longitudinal hole 15 passing through a center part of the fixed core 14, and a fuel supply tube 16 communicating with the longitudinal hole 15 is coaxially and integrally connected to the other end part of the fixed core 14. Thus, the valve housing 9, the fixed core 14, and the fuel supply tube 16 are coaxially disposed on a central axis X of the fuel injection valve I and integrally connected to one another.

The magnetic cylindrical body 12 integrally has a flange-shaped yoke portion 12*a* in an intermediate part in the axial direction of the magnetic cylindrical body 12, and an annular cushion ring 18 usable also as a seal ring is disposed between the yoke portion 12*a* and the cylinder head 5. The cushion ring 18 is fitted onto the outer periphery of the magnetic cylindrical body 12 and housed in an annular recess 17 that is provided in the cylinder head 5 so as to surround the outer end of the valve fitting hole 7.

A fuel filter 19 is fitted into the other end part, that is, an inlet, of the fuel supply tube 16, and the fuel supply tube 16 is fitted, via an annular seal member 22, with a fuel supply cap 21 provided on a fuel distribution pipe 20. A bracket 23 is engaged with a top part of the fuel supply cap 21 and removably fastened by an appropriate fixing means (for example, a bolt) to a support post, which is not illustrated, standingly provided on the cylinder head 5.

An elastic member 26, which is formed from a plate spring, is disposed between a tip end of the fuel supply cap 21 and an annular step part 25 provided on an intermediate part of the fuel supply tube 16 and facing the fuel supply cap 21 side. The fuel supply tube 16, that is, the electromagnetic fuel injection valve I, is clamped between the cylinder head 5 and the elastic member 26 by the resilient force exhibited by this elastic member 26.

The valve seat member 11 is formed into a bottomed cylindrical shape having an end wall portion 11*a* on one end part of the valve seat member 11, a conical valve seat 27 is formed on the end wall portion 11*a*, and a plurality of fuel discharge holes 28 are provided so as to open in the vicinity of the center of the valve seat 27. This valve seat member 11 is fitted into and welded to one end part of the housing body 10 so that the fuel discharge holes 28 open toward the combustion chamber 6. That is, the valve housing 9 is formed so as to have the valve seat 27 on one end part of the valve housing 9. Note that the plurality of fuel discharge holes may be provided in an injector plate retrofitted and fixed to the valve seat member 11.

A coil assembly 30 is fitted onto an outer peripheral face from the other end part of the magnetic cylindrical body 12 to the fixed core 14. This coil assembly 30 includes a bobbin 31 fitted onto the outer peripheral face and a coil 32 wound around the bobbin 31, and one end part of a coil housing 33 surrounding the coil assembly 30 is joined to the outer peripheral part of the yoke portion 12*a* of the magnetic cylindrical body 12.

The outer periphery of the other end part of the fixed core 14 is covered with a covering layer 34, made of a synthetic resin, molded so as to connect with the other end part of the coil housing 33, and a coupler 34*a* for retaining a terminal 35 connected to the coil 32 is formed integrally with the covering layer 34 so as to project toward one side of the electromagnetic fuel injection valve I.

Figure 3:
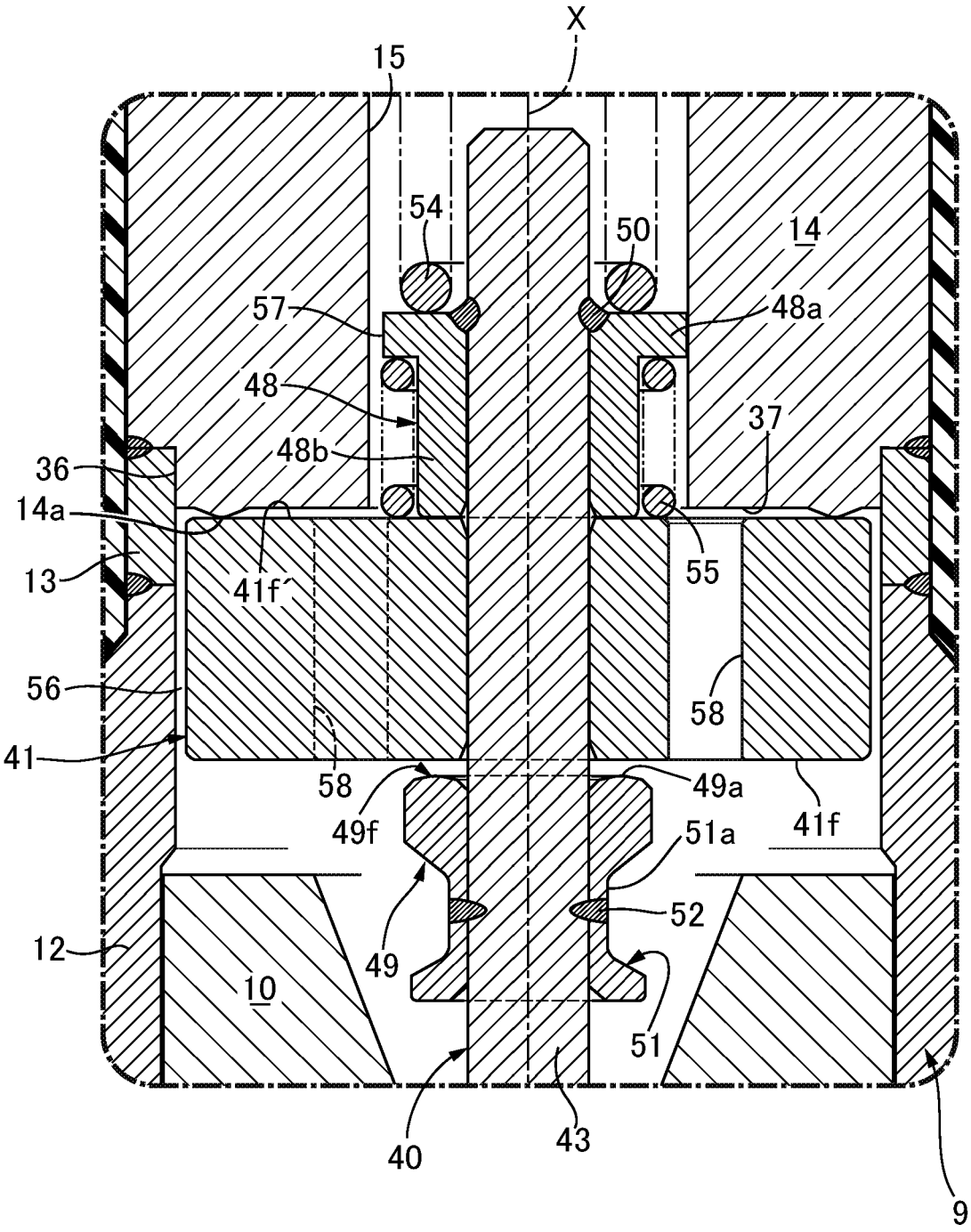
FIG. 3 is a sectional view corresponding to FIG. 2, which shows a valve-open state of the fuel injection valve.

Referring also to FIG. 3, an annular recess 36 is formed in the outer periphery of the one end part of the fixed core 14, and the other end part of the non-magnetic cylindrical body 13 is fitted into and liquid-tightly welded to the annular recess 36 so that an outer peripheral face of the other end part of the non-magnetic cylindrical body 13 is continuous with the fixed core 14. One end face, facing an interior of the valve housing 9, of the fixed core 14 functions as an attracting face 37 that can magnetically attract a movable core 41 described later.

One part of a valve body 40 and a movable core 41 are housed within the valve housing 9 from the valve seat member 11 to the non-magnetic cylindrical body 13. The valve body 40 is formed by providing a rod 43 so as to be connected to a valve part 42 opening and closing the fuel discharge holes 28 in cooperation with the valve seat 27, the rod 43 extending to the interior of the longitudinal hole 15 of the fixed core 14. The valve part 42 is formed into a spherical shape so as to slide within the valve seat member 11, and the rod 43 is formed so as to have a smaller diameter than that of the valve part 42. An annular fuel flow path 44 is defined between the valve seat member 11 and the rod 43, and a plurality of flat parts 45 are formed on an outer peripheral face of the valve part 42 so as to form a fuel flow path between themselves and the valve seat member 11. Therefore, the valve seat member 11 allows fuel to pass therethrough while guiding opening and closing of the valve body 40.

The movable core 41 is slidably fitted onto the rod 43, the movable core 41 being disposed so as to oppose the attracting face 37 of the fixed core 14. When the coil 32 is energized, the movable core 41 is attracted toward the attracting face 37 of the fixed core 14 and abuts against a valve-open side stopper 48, the valve-open side stopper 48 being fixed to the rod 43 so that the valve body 40 is opened by the movable core 41 abutting against the valve-open side stopper 48. Moreover, a valve-closed side stopper 49 is disposed on and fixed to the rod 43 on a side closer to the valve seat 27 than the valve-open side stopper 48 and the movable core 41. The sliding stroke of the movable core 41 along the rod 43 between the valve-closed side stopper 49 and the valve-open side stopper 48 is prescribed to be within a limited predetermined range.

The valve-open side stopper 48 is formed from a flange portion 48*a* slidably fitted into an inner peripheral face of the longitudinal hole 15 and a cylindrical shaft portion 48*b* projecting from the flange portion 48*a* toward the movable core 41 side. An inner peripheral part of the flange portion 48*a* is welded to the rod 43 by a weld bead 50, and the valve-open side stopper 48 is disposed so that part of the shaft portion 48*b* projects further toward the movable core 41 side than the attracting face 37 when the valve body 40 is at a valve-closed position. On the other hand, an annular groove 51 is formed in the outer periphery of the valve-closed side stopper 49, and the valve-closed side stopper 49 is fixed to the rod 43 by a weld bead 52 extending through a groove bottom 51*a* of the annular groove 51.

The valve-open side stopper 48 is formed from a non-magnetic or weakly magnetic material having higher hardness than that of the fixed core 14, for example martensitic stainless steel.

Referring again to FIG. 1, a pipe-shaped retainer 53 is fitted into and fixed by swaging to the longitudinal hole 15 of the fixed core 14. A valve spring 54 is provided in a compressed state between the retainer 53 and the flange portion 48*a* of the valve-open side stopper 48, the valve spring 54 urging the valve body 40 in a direction in which the valve body 40 is seated on the valve seat 27, that is, the valve-closing direction.

Furthermore, an auxiliary spring 55 surrounding the shaft portion 48*b* of the valve-open side stopper 48 is provided in a compressed state between the flange portion 48*a* of the valve-open side stopper 48 and the movable core 41. This auxiliary spring 55 has a set load smaller than the set load of the valve spring 54 and exhibits a spring force that always urges the movable core 41 toward the side on which the movable core 41 moves away from the valve-open side stopper 48 and abuts against the valve-closed side stopper 49.

The other end part of the rod 43 projects from the flange portion 48*a* of the valve-open side stopper 48 and is fitted into an inner peripheral face of a movable end part of the valve spring 54, thus playing a role in positioning the valve spring 54. Moreover, the shaft portion 48*b* of the valve-open side stopper 48 is fitted into an inner peripheral face of the auxiliary spring 55 to thus play a role in positioning the auxiliary spring 55.

Figure 2:
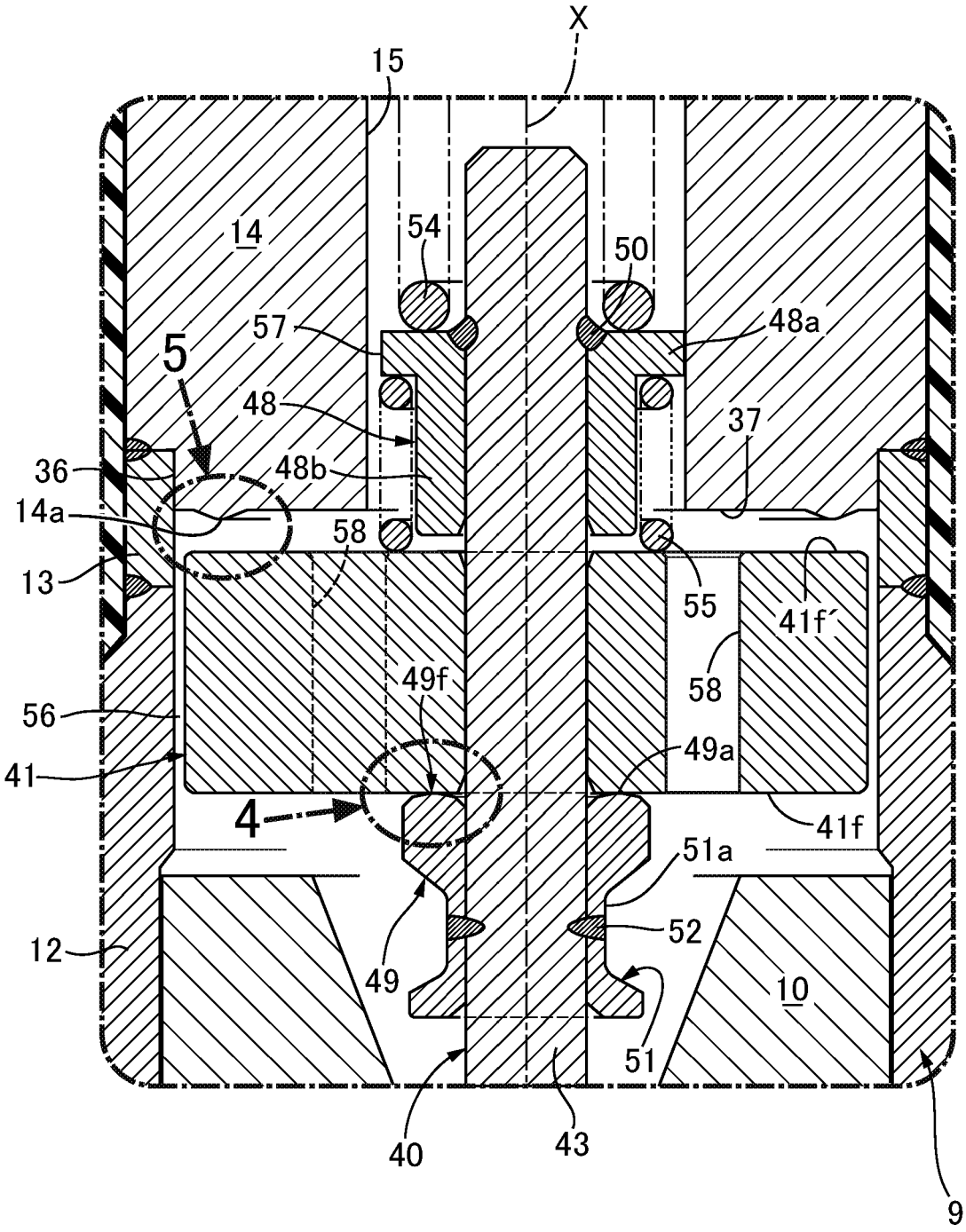
FIG. 2 is an enlarged sectional view of a part indicated by arrow 2 in FIG. 1, which shows a valve-closed state of the fuel injection valve.

As is clear from FIGS. 2 and 3, an annular gap 56 is ensured between the outer peripheral face of the movable core 41 and inner peripheral faces of the magnetic cylindrical body 12 and non-magnetic cylindrical body 13. A flat part 57 is provided at a plurality of locations of the outer periphery of the flange portion 48*a* of the valve-open side stopper 48, the flat parts 57 forming a fuel flow path, and a plurality of through holes 58 are provided in the movable core 41, the through holes 58 forming a fuel flow path.

In such an electromagnetic fuel injection valve I, when the coil 32 is in a non-energized state, as is clear from FIGS. 1 and 2, the valve body 40 is pushed by the set load of the valve spring 54 and is made to seat on the valve seat 27 to thus close the fuel discharge holes 28. That is, in the valve-closed state, the movable core 41 is retained in a state in which the movable core 41 is made to abut against the valve-closed side stopper 49 by the set load of the auxiliary spring 55, thus maintaining a predetermined gap from the fixed core 14.

When the coil 32 is energized in such a valve-closed state, the resulting magnetic force makes the movable core 41 be attracted to the fixed core 14 and abut against the valve-open side stopper 48 while compressing the auxiliary spring 55. That is, since at a time of initial movement, the movable core 41 slides against the set load of the auxiliary spring 55, which is smaller than that of the valve spring 54, when the movable core 41 experiences an attracting force from the fixed core 14 the movable core 41 slides smoothly and abuts against the valve-open side stopper 48 while accelerating.

When the movable core 41 abuts against the valve-open side stopper 48, the movable core 41 smoothly pushes and moves the valve-open side stopper 48 against the set load of the valve spring 54, and the movable core 41 collides with the attracting face 37 and stops. During this process, since the valve-open side stopper 48, which is pushed and moves, is fixed to the rod 43, the valve part 42 is detached from the valve seat 27, and a valve-open state is attained.

When the movable core 41 abuts against the attracting face 37 with an impact, the valve body 40, which is formed from the valve part 42 and the rod 43, overshoots due to its inertia, but since the valve-closed side stopper 49, which is integral with the valve body 40, collides with the movable core 41, the overshoot is stopped. During this process, since the valve-open side stopper 48 increases the compressive deformation of the valve spring 54 while moving away from the movable core 41 by an amount corresponding to the overshoot of the valve body 40, overshooting of the valve body 40 is also suppressed by the repulsive force of the valve spring 54.

When overshooting stops, the valve-open side stopper 48 is returned by the repulsive force of the valve spring 54 to a position at which the valve-open side stopper 48 abuts against the movable core 41, which is abutting against the attracting face 37, and the valve body 40 is retained at a predetermined valve-opening position as shown in FIG. 3. In this arrangement, since the set load of the auxiliary spring 55 is set smaller than the set load of the valve spring 54, which urges the valve body 40 in the valve-closing direction, when the coil 32 is energized the auxiliary spring 55 does not interfere with attraction of the movable core 41 toward the fixed core 14 and abutment of the valve-open side stopper 48 against the movable core 41 by the valve spring 54, and does not inhibit returning of the valve body 40 to the predetermined valve-opening position.

In this way, since in the process of opening of the valve body 40, the impact force that the movable core 41 applies to the attracting face 37 can be divided into an impact force when only the movable core 41 first collides with the attracting face 37 and an impact force when the valve-closed side stopper 49 subsequently collides with the movable core 41, each of the collision energies is relatively small, and it is possible to prevent wear of the abutting part between the attracting face 37 and the movable core 41 and to suppress the collision noise to a low level. Moreover, since when the valve-closed side stopper 49 collides against the movable core 41 the valve spring 54 is deformed by a larger amount than the amount of compressive deformation when the valve opens normally, the valve spring 54 absorbs the collision energy of the valve-closed side stopper 49 against the movable core 41, thus alleviating the impact force.

When the valve body 40 opens, fuel that is fed under pressure from a fuel pump, which is not illustrated, to the fuel supply tube 16 goes in sequence through the interior of the pipe-shaped retainer 53, the longitudinal hole 15 of the fixed core 14, the flat parts 57 around the valve-open side stopper 48, the through holes 58 of the movable core 41, the interior of the valve housing 9, and the flat parts 45 around the valve part 42, and is injected from the fuel discharge holes 28 directly into the combustion chamber 6 of the internal combustion engine E.

When energization of the coil 32 is subsequently cut off, since the valve-open side stopper 48 is pushed by the repulsive force of the valve spring 54, the valve-open side stopper 48 moves toward the valve seat 27 side together with the movable core 41 and the valve body 40, thus making the valve part 42 be seated on the valve seat 27. In this process, the movable core 41 descends with a slight delay after the valve part 42 has been seated on the valve seat 27, due to the influence of residual magnetism between the movable core 41 and the fixed core 14 and the relatively small set load of the auxiliary spring 55, which makes the movable core 41 descend forward.

When the valve body 40 is seated on the valve seat 27 for the first time, the valve body 40 rebounds due to the seating impact, but since the movable core 41, which descends after a delay, abuts against the valve-closed side stopper 49 fixed to the rebounding valve body 40, the amount of rebound of the valve body 40 can be minimized.

If rebounding of the valve body 40 is suppressed, the valve body 40 is retained in a valve-closed state by the repulsive force of the valve spring 54 to thus suspend fuel injection, and the movable core 41 is held in a state in which it is made to abut against the valve-closed side stopper 49 by the repulsive force of the auxiliary spring 55 (see FIG. 2).

As described above, during the process of closing the valve body 40, since the impact force that the valve body 40 applies to the valve seat 27 can be divided into the impact force when only the valve body 40 is first seated on the valve seat 27 and the impact force when the movable core 41 subsequently collides with the valve-closed side stopper 49, each of the collision energies is relatively small. Furthermore, when the valve body 40 is seated on the valve seat 27 for the first time, it rebounds due to the seating impact and is subsequently seated on the valve seat 27 again and delivers an impact, but since the valve-closing stroke after the rebound of the valve body 40 is much smaller than the valve-closing stroke from the usual valve-open position of the valve body 40, the impact force acting on the valve seat 27 is very small. This enables wear of the parts where the valve part 42 and the valve seat 27 seat against each other to be prevented and the seating noise to be suppressed.

In the fuel injection valve I explained above, a characteristic structure as shown below is further added. The structure is now explained, referring mainly to FIGS. 4 and 5.

Figure 4:
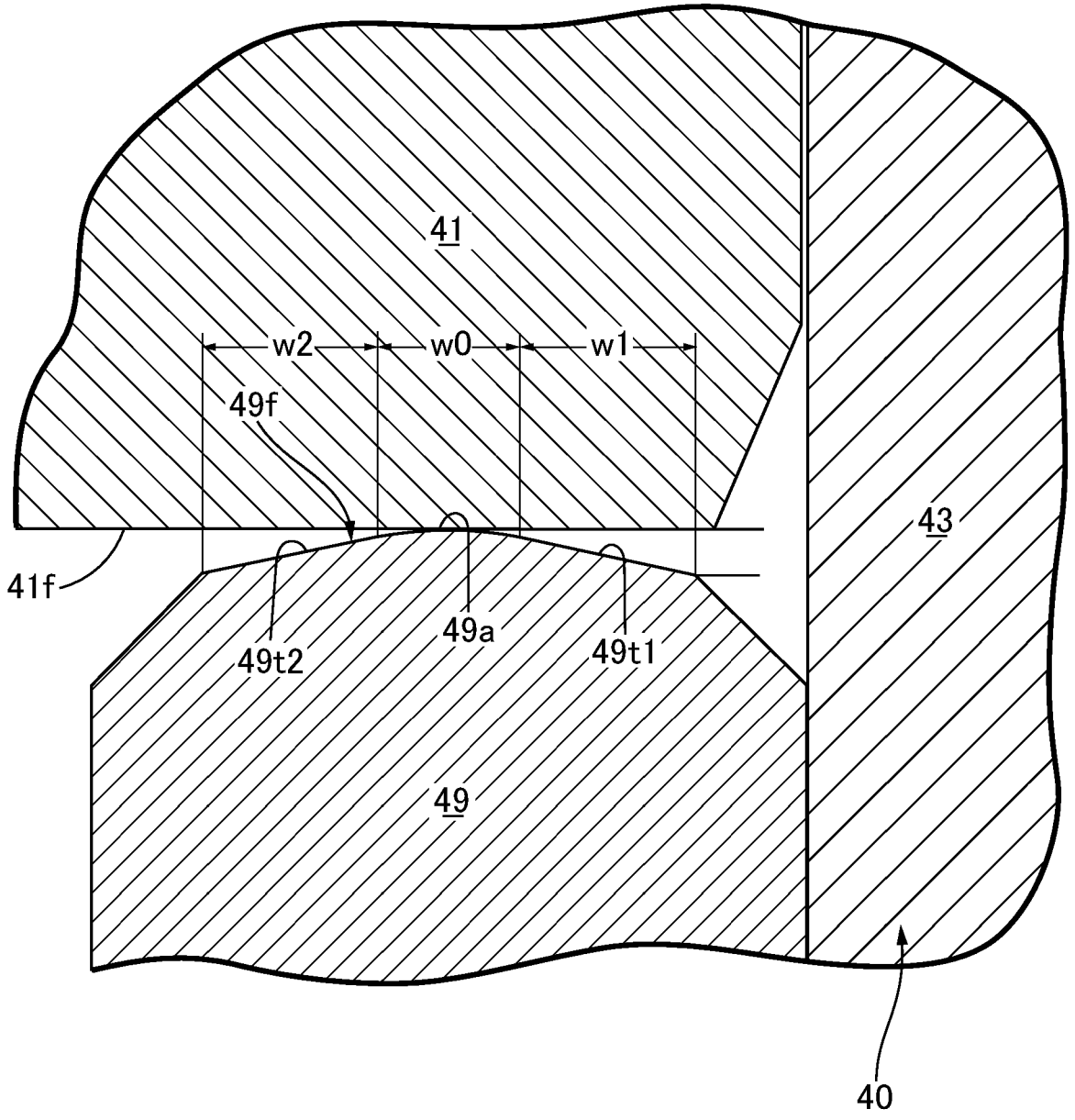
FIG. 4 is an enlarged sectional view showing an abutting part between a valve-closed side stopper and a movable core (an enlarged view of a part indicated by arrow 4 in FIG. 2).

An essential part of the embodiment, which corresponds to the first to third aspects of the present invention, is shown in FIG. 4. That is, the valve-closed side stopper 49 has a surface opposing the movable core 41, that is, a stopper face 49*f*, and the stopper face 49*f* includes an annular first curved face part 49*a*, a first taper face 49*t*1, and a second taper face 49*t*2, the first curved face part 49*a* being able to abut against the movable core 41, concentrically surrounding the rod 43, and being formed into an arc shape curved convexly toward the movable core 41 as seen in a cross section including a central axis of the rod 43 (which coincides with the central axis X of the fuel injection valve I), the first taper face 49*t*1 being continuous to an inner peripheral side of the first curved face part 49*a* and gradually separated from the movable core 41 in going radially inward from the first curved face part 49*a*, the second taper face 49*t*2 being continuous to an outer peripheral side of the first curved face part 49*a* and gradually separated from the movable core 41 in going radially outward from the first curved face part 49*a*.

The stopper face 49*f* further includes an inner taper face and an outer taper face, the inner taper face being continuous to an inner peripheral side of the first taper face 49*t*1 and separated from the movable core 41 at a gradient larger than that of the first taper face 49*t*1, the outer taper face being continuous to an outer peripheral side of the second taper face 49*t*2 and separated from the movable core 41 at a gradient larger than that of the second taper face 49*t*2.

The first and second taper faces 49*t*1, 49*t*2 respectively extend in a tangential direction of the first curved face part 49*a* so as to be continuous to the first curved face part 49*a*, and respective radial widths w1, w2 of the first and second taper faces 49*t*1, 49*t*2 are set larger than a radial width w0 of the first curved face part 49*a*.

In a process of machining the stopper face 49*f* of the valve-closed side stopper 49, the first and second taper faces 49*t*1, 49*t*2 and the first curved face part 49*a* are machined by a method and steps, for example, in which the first taper face 49*t*1 and the first curved face part 49*a* are sequentially formed from a radially inner side of the valve-closed side stopper 49 toward an apex of the first curved face part 49*a*, and the second taper face 49*t*2 and the first curved face part 49*a* are formed sequentially from a radially outer side of the valve-closed side stopper 49 toward the apex of the first curved face part 49*a*.

Figure 5:
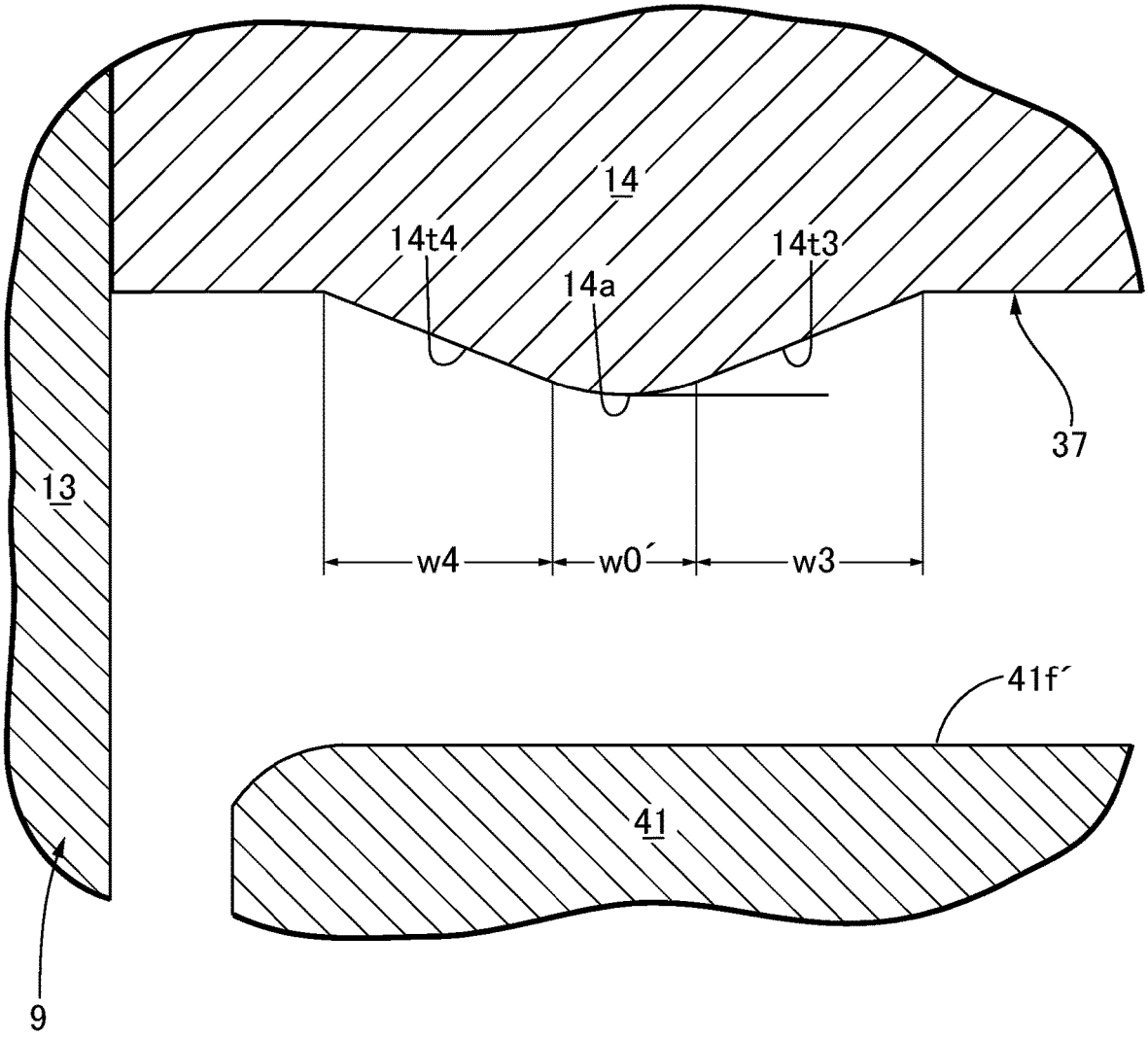
FIG. 5 is an enlarged sectional view showing an essential part of an attracting face of a fixed core and an end face of the movable core opposing the attracting face (an enlarged view of a part indicated by arrow 5 in FIG. 2).

Moreover, an essential part of the embodiment, which corresponds to the fourth aspect of the present invention, is shown in FIG. 5. That is, one (in the illustrated example, the attracting face 37 of the fixed core 14) of the mutually opposing surfaces of the fixed core 14 and the movable core 41 includes an annular second curved face part 14*a*, a third taper face 14*t*3, and a fourth taper face 14*t*4, the second curved face part 14*a* being able to abut against the other (in the illustrated example, an upper end face 41*f'* of the movable core 41) of the mutually opposing surfaces, concentrically surrounding the rod 43, and being formed into an arc shape curved convexly toward the other opposing surface as seen in a cross section including the central axis of the rod 43, the third taper face 14*t*3 being continuous to an inner peripheral side of the second curved face part 14*a* and gradually separated from the upper end face 41*f'* as the other opposing surface in going radially inward from the second curved face part 14*a*, the fourth taper face 14*t*4 being continuous to an outer peripheral side of the second curved face part 14*a* and gradually separated from the upper end face 41*f'* as the other opposing surface in going radially outward from the second curved face part 14*a*.

Note that the third and fourth taper faces 14*t*3, 14*t*4 and the second curved face part 14*a* may be machined by the same method and steps as in machining of the first and second taper faces 49*t*1, 49*t*2 and the first curved face part 49*a*.

The operation of the embodiment is now explained. In the fuel injection valve I of the present embodiment, the stopper face 49*f*, opposing the movable core 41, of the valve-closed side stopper 49 includes the annular first curved face part 49*a* that has the cross section curved convexly toward the movable core 41 and can abut against a lower end face 41*f* of the movable core 41. Therefore, in the valve-closed state, the valve-closed side stopper 49 locally abuts against the movable core 41 by bringing the first curved face part 49*a* into line contact with the movable core 41, an abutting area therebetween can be greatly reduced, and thus, it is possible to effectively reduce an influence of viscosity resistance of fuel between the movable core 41 and the valve-closed side stopper 49, which may cause sticking of an abutting part therebetween. Accordingly, since the movable core 41 smoothly moves away from the valve-closed side stopper 49 in the initial stage of the valve-opening process, valve-opening responsiveness can be improved, and the fuel injection valve I can be controlled with higher accuracy. Moreover, since the valve-closed side stopper 49 surely abuts via the curved face part 49*a* (that is, does not abut via an edge) against the movable core 41, a collision force, and therefore, stresses of the abutting part and peripheral parts thereof, at the time of abutting are alleviated.

Furthermore, the stopper face 49*f* of the valve-closed side stopper 49 includes the first taper face 49*t*1 and the second taper face 49*t*2, the first taper face 49*t*1 being continuous to the inner peripheral side of the first curved face part 49*a* and gradually separated from the movable core 41 in going radially inward from the first curved face part 49*a*, the second taper face 49*t*2 being continuous to the outer peripheral side of the first curved face part 49*a* and gradually separated from the movable core 41 in going radially outward from the first curved face part 49*a*. Accordingly, parts, adjacent to the first curved face part 49*a*, of the stopper face 49*f* are formed as the first and second taper faces 49*t*1, 49*t*2 that gradually recede from the first curved face part 49*a*, and thus, without being interfered by the adjacent parts, it is possible to easily and highly accurately machine the first curved face part 49*a* over an entire region thereof sandwiched between the first and second taper faces 49*t*1, 49*t*2.

Moreover, in the present embodiment, since the first and second taper faces 49*t*1, 49*t*2 each extend in the tangential direction of the first curved face part 49*a* so as to be continuous to the first curved face part 49*a*, the first curved face part 49*a* and each of the first and second taper faces 49*t*1, 49*t*2 can be connected smoothly with each other without any step, and thus, machining can be smoothly transferred from each of the first and second taper faces 49*t*1, 49*t*2 to the first curved face part 49*a*.

Moreover, in the present embodiment, the respective radial widths w1, w2 of the first and second taper faces 49*t*1, 49*t*2 are both set larger than the radial width w0 of the first curved face part 49*a*. In this way, due to the first and second taper faces 49*t*1, 49*t*2 each having a wide width, it is possible to reduce the radial width of the first curved face part 49*a* while securing an axial protrusion height thereof, and therefore, the first curved face part 49*a* which requires highly accurate machining is reduced in width (and consequently, reduced in machining amount), thereby improving machining efficiency and reducing the cost.

Moreover, in the present embodiment, the surface, opposing the movable core 41, of the fixed core 14, that is, the attracting face 37 includes the annular second curved face part 14*a* that has the cross section curved convexly toward the movable core 41 and can abut against the upper end face 41*f'* of the movable core 41. Therefore, also on an upstream side of the movable core 41, since the second curved face part 14*a* of the attracting face 37 is made to abut against the upper end face 41*f'* of the movable core 41 in a line contact state, the abutting area therebetween can be greatly reduced, and thus, it is possible to effectively reduce influences of residual magnetism and viscosity resistance of fuel between the movable core 41 and the fixed core 14, which may cause sticking of the abutting part therebetween. Accordingly, since the movable core 41 smoothly moves away from the fixed core 14 in the initial stage of the valve-closing process, valve-closing responsiveness can be improved, and the fuel injection valve I can be controlled with higher accuracy. Moreover, since the movable core 41 and the fixed core 14 surely abut via the curved face part 14*a* (that is, does not abut via an edge) against each other, a collision force, and therefore, stresses of the abutting part and peripheral parts thereof, at the time of abutting are alleviated.

Furthermore, the attracting face 37 includes the third taper face 14*t*3 and the fourth taper face 14*t*4, the third taper face 14*t*3 being continuous to the inner peripheral side of the second curved face part 14*a* and gradually separated from the movable core 41 in going radially inward from the second curved face part 14*a*, the fourth taper face 14*t*4 being continuous to the outer peripheral side of the second curved face part 14*a* and gradually separated from the movable core 41 in going radially outward from the second curved face part 14*a*. Accordingly, parts, adjacent to the second curved face part 14*a*, of the attracting face 37 are formed as the third and fourth taper faces 14*t*3, 14*t*4 that gradually recede from the second curved face part 14*a*, and thus, without being interfered by the adjacent parts, it is possible to easily and highly accurately machine the second curved face part 14*a* over an entire region thereof sandwiched between the third and fourth taper faces 14*t*3, 14*t*4. Moreover, in the present embodiment, the third and fourth taper faces 14*t*3, 14*t*4 each extend in a tangential direction of the second curved face part 14*a* so as to be continuous to the second curved face part 14*a*. Accordingly, the second curved face part 14*a* and each of the third and fourth taper faces 14*t*3, 14*t*4 can be connected smoothly with each other without any step, and thus, machining can be smoothly transferred from each of the third and fourth taper faces 14*t*3, 14*t*4 to the second curved face part 14*a*.

Furthermore, respective radial widths w3, w4 of the third and fourth taper faces 14*t*3, 14*t*4 are both set larger than a radial width w0' of the second curved face part 14*a*. In this way, due to the third and fourth taper faces 14*t*3, 14*t*4 each having a relatively wide width, it is possible to reduce the radial width of the second curved face part 14*a* while securing an axial protrusion height thereof, and therefore, the second curved face part 14*a* which requires highly accurate machining is reduced in width (and consequently, reduced in machining amount), thereby improving machining efficiency and reducing the cost.

An embodiment of the present invention is explained above, but the present invention is not limited to the above-mentioned embodiment and may be modified in a variety of ways as long as the modifications do not depart from the gist of the present invention.

For example, the embodiment illustrates a case in which the second curved face part 14*a* and the third and fourth taper faces 14*t*3, 14*t*4 are provided in the attracting face 37 which is the opposing surface on the fixed core 14 side out of the mutually opposing surfaces of the fixed core 14 and the movable core 41, and the second curved face part 14*a* is made to abut against a flat part of the upper end face 41*f'* of the movable core 41, but contrary to the embodiment, the second curved face part and the third and fourth taper faces may be provided in the upper end face 41*f'*, opposing the fixed core 14, of the movable core 41, and the second curved face part may be made to abut against a flat part of the attracting face 37 of the fixed core 14.

Moreover, the embodiment illustrates a case in which the valve-open side stopper 48 is slidably fitted and supported directly on the inner periphery of the longitudinal hole 15 of the fixed core 14, but the valve-open side stopper 48 may be slidably fitted and supported on the fixed core 14 via a not-illustrated guide bush that has been fitted and fixed on the inner periphery of the longitudinal hole 15 of the fixed core 14.

What is claimed is:

1. An electromagnetic fuel injection valve comprising a valve housing that has a valve seat in one end part thereof, a hollow fixed core that is connected to another end of the valve housing, a coil that is disposed around an outer periphery of the fixed core, a valve body that is formed by a valve part and a rod connected to the valve part that operates in cooperation with the valve seat, a movable core that is slidably fitted onto the rod while opposing an attracting face of the fixed core, a valve-open side stopper that is fixed to the rod, and configured to make the valve body open by abutting against the movable core that is attracted to the attracting face when the coil is energized, a valve-closed side stopper that is fixed to the rod on a side closer to the valve seat than the valve-open side stopper and capable of abutting against the movable core, a valve spring that urges the valve body in a valve-closing direction, and an auxiliary spring that exhibits a spring force that urges the movable core to move away from the valve-open side stopper and abut against the valve-closed side stopper when the coil is unenergized, wherein a surface, opposing the movable core, of the valve-closed side stopper includes an annular first curved face part, a first taper face, and a second taper face, the first curved face part having a cross section curved convexly toward the movable core and being capable of abutting against the movable core, the first taper face being continuous to an inner peripheral side of the first curved face part and gradually separated from the movable core in going radially inward from the first curved face part, the second taper face being continuous to an outer peripheral side of the first curved face part and gradually separated from the movable core in going radially outward from the first curved face part.

2. The electromagnetic fuel injection valve according to claim 1, wherein the first and second taper faces respectively extend in a tangential direction of the first curved face part so as to be continuous to the first curved face part.

3. The electromagnetic fuel injection valve according to claim 1, wherein respective radial widths of the first and second taper faces are larger than a radial width of the first curved face part.

4. The electromagnetic fuel injection valve according to claim 1, wherein one of mutually opposing surfaces of the fixed core and the movable core includes an annular second curved face part, a third taper face, and a fourth taper face, the second curved face part having a cross section curved convexly toward another one of the mutually opposing surfaces and being capable of abutting thereagainst, the third taper face being continuous to an inner peripheral side of the second curved face part and gradually separated from the other opposing surface in going radially inward from the second curved face part, the fourth taper face being continuous to an outer peripheral side of the second curved face part and gradually separated from the other opposing surface in going radially outward from the second curved face part.

* * * * *